US007417411B2

(12) United States Patent
Hoffman et al.

(10) Patent No.: US 7,417,411 B2
(45) Date of Patent: Aug. 26, 2008

(54) APPARATUS AND METHOD FOR MONITORING TAP POSITIONS OF LOAD TAP CHANGER

(75) Inventors: Gary R. Hoffman, Randolph, NJ (US); Thomas C. Tennille, Milledgeville, GA (US)

(73) Assignee: Advanced Power Technologies, LLC, Randolph, NJ (US)

( * ) Notice: Subject to any disclaimer, the term of this patent is extended or adjusted under 35 U.S.C. 154(b) by 0 days.

(21) Appl. No.: 11/520,821

(22) Filed: Sep. 13, 2006

(65) Prior Publication Data

US 2007/0057652 A1 Mar. 15, 2007

Related U.S. Application Data

(60) Provisional application No. 60/717,000, filed on Sep. 14, 2005, provisional application No. 60/716,996, filed on Sep. 14, 2005.

(51) Int. Cl.
*G05F 1/147* (2006.01)

(52) U.S. Cl. ..... 323/256; 318/603

(58) Field of Classification Search ..... 323/234, 323/241, 247, 255, 256; 318/600–604, 626
See application file for complete search history.

(56) References Cited

U.S. PATENT DOCUMENTS

| | | | | |
|---|---|---|---|---|
| 5,545,974 | A * | 8/1996 | Trainor et al. | 323/340 |
| 5,550,460 | A * | 8/1996 | Bellin et al. | 323/255 |
| 5,568,398 | A * | 10/1996 | Trainor | 700/298 |
| 5,619,121 | A * | 4/1997 | Trainor | 323/256 |
| 5,633,580 | A * | 5/1997 | Trainor et al. | 323/256 |
| 5,804,954 | A * | 9/1998 | Laplace, Jr. | 323/256 |
| 6,856,122 | B2 * | 2/2005 | Dohnal et al. | 323/258 |

* cited by examiner

*Primary Examiner*—Bentsu Ro
(74) *Attorney, Agent, or Firm*—Henry I. Schanzer

(57) ABSTRACT

A load tap changer (LTC) having a plurality of windings is coupled to one of the primary and secondary windings of a power transformer in order to regulate the output voltage of the power transformer. The LTC includes a plurality of taps physically and electrically connected to the LTC windings and the transformer's output voltage is increased/decreased by moving along the taps a contacting element whose movement is controlled by a rotating shaft driven by a motor. The tap being contacted is determined by sensing the direction and number of shaft rotations and by checking the number of shaft rotations specified to go from a tap to the next tap being contacted. The time for a full rotation of the shaft is also measured. Also, the temperature of the tanks containing the LTC taps and the power transformer is measured for each tap position.

15 Claims, 10 Drawing Sheets

LOAD TAP CHANGER IN PRIMARY CIRCUIT

LOAD TAP CHANGER IN SECONDARY CIRCUIT

APPARATUS AND METHOD FOR MONITORING TAP POSITIONS OF LOAD TAP CHANGER

This invention claims priority from provisional application Ser. No. 60/717,000 for Load Tap Changer Position Monitoring Method filed Sep. 14, 2005 and application Ser. No. 60/716,996 titled Load Tap Changer Condition Monitoring Method filed Sep. 14, 2005.

BACKGROUND OF THE INVENTION

This invention relates to apparatus and method for monitoring and displaying the tap positions of a load tap changer (LTC).

Load Tap Changers (LTCs) are used in electric power systems to regulate the voltage distributed from substations and along the power lines. An LTC, as used and defined herein and in the appended claims, may be connected in the primary circuit of a power transformer, XFR, as shown in FIG. 1, or in the secondary circuit as shown in FIG. 2. FIG. 1, is a highly simplified version of a prior art system illustrating use of one type of LTC connected in the primary circuit of a power transformer (XFR). In FIG. 1, there is shown the primary (P1) of a power transformer (XFR) to which is coupled the windings 100*a* and taps 100*b* of a load tap changer (LTC), 100. Note that in the discussion to follow and in the appended claims, windings 100*a*, whether connected in the primary or the secondary of the power transformer, may also be referred to as the LTC windings. The LTC may be used to change the effective turns ratio (N1:N2) of the primary and secondary of the power transformer XFR and thereby its output voltage (Vout). The LTC 100 of FIG. 1 is shown to include several taps ($T_0$-$T_M$) which are contacted with a movable contacting element, or contact, C1. The number of taps may vary from a few to many. The movable contact C1 is shown mounted on a tap changer mechanism 105 which is caused to move along the taps $T_0$-$T_M$ by a rotatable shaft 103 driven by a motor M1. The shaft 103 can move in a clockwise direction or in a counterclockwise direction and causes contact C1 to advance from tap to tap. For purpose of illustration, in FIG. 1, the contact C1 is shown to be movable in either a down to up direction (from $T_0$ to $T_M$) or in an up to down direction (from $T_M$ to $T_0$). In actual systems, the taps may be physically arranged in a circular pattern and the contacting element would then move along a rotary or other suitable path, rather than linearly up and down.

In FIG. 1, the windings 100*a*, extending between nodes 14 and 16, are connectable in series with the primary windings (P1) of the power transformer XFR. One end 11 of P1 is connected to an input power terminal 17 while the other end 13 of P1 is connected to the top end 14 of the windings 100*a*. Taps $T_0$ through $T_M$ are disposed along the LTC windings, with the lowest tap, To, corresponding to node 16 and the highest tap, $T_M$, corresponding to node 14. For ease of illustration, contact C1, shown mounted on a movable arm depending from mechanism 105, is electrically connected to input power terminal 19 and provides a very low impedance connection between terminal 19 and whichever tap it is contacting. The input power Vin is applied between terminals 17 and 19 and is redistributed via the secondary of the power transformer, XFR, onto output power lines 21, 23. When C1 is connected to tap $T_0$ the primary winding P1 is connected in series with all the windings 100*a* of the LTC and the effective turns ratio of the primary (e.g., N1) to the secondary (e.g., N2) has been increased. For this condition, the output voltage (Vout) produced at the output of the secondary (SEC1) is decreased. When C1 is connected to tap $T_M$ the effective turns ratio of the primary to the secondary is decreased and the output voltage (Vout) produced at the output of the secondary (SEC1) is increased.

In the operation of the system (see FIGS. 1 and 2) the voltage Vout, across the secondary of the power transformer is supplied, via a transformer PT10, to a tap change controller 101 which senses the voltage and produces signals identified as K1 (lower) and K2 (raise). Signals K1 and K2 are applied to the motor M1 and determine whether the motor is driven in a clockwise or counterclockwise direction causing shaft 103 to turn so as to raise or lower tap changer mechanism 105 causing C1 to move along the taps of the LTC windings 100*a*. If Vout is below some desired level, the controller 101 produces signals (K1, K2) which function to tend to raise Vout to the desired value. Likewise, if Vout is above some desired level, controller 101 produces signals (K1, K2) which function to tend to lower Vout to the desired value.

As noted, motor M1 causes the rotation of drive shaft 103 on which is mounted tap changer mechanism 105 which controls the movement of contacting element C1 along the taps 100*b* of LTC windings 100*a*. Mechanism 105 may include gears, cams and switches (not shown) which cause the contact C1 to make contact with the taps in a predetermined sequence.

In the configuration of FIG. 2, windings 100*a* are connectable in series with the windings of the secondary of the power transformer. As in FIG. 1, which one(s) of the windings 100*a* get connected in circuit with the secondary windings is a function of which tap is contacted by contact C1. For the condition of contact C1 connected to tap $T_0$, the turns ratio of the primary to secondary is decreased (Vout is increased). For the condition of contact C1 connected to tap $T_M$, the turns ratio of the primary to secondary is increased (Vout is decreased). In FIG. 2, as in FIG. 1, the voltage across the secondary is coupled via a transformer PT10 to a tap change controller 101 which drives a motor M1 which drives a shaft 103*a* which causes a mechanism 105*a* to raise or lower the contact C1 to produce a desired Vout. Thus in FIGS. 1 and 2 there is a feedback loop including controller 101 which functions to try to maintain the output voltage at a desired value.

However, a problem exists in that some of the taps may be, or become inoperative. When the system tries to make contact with an inoperative tap, there may be overshoots and/or undershoots, and/or continuous hunting for the desired setting. Known systems do not resolve the problem of identifying "bad" taps and/or any sluggishness and/or delays in the operation and response time of the system including the LTC.

For purpose of ensuring the proper operation of the power distribution system and for maintenance of the power transformer and/or the LTC it is desirable, and/or necessary, to know and display which tap is being contacted, at any time and whether there are problems associated with any of the taps and/or the response time of the system in going from a tap to the next tap (up or down).

SUMMARY OF THE INVENTION

A system embodying the invention includes a power transformer having a primary winding and a secondary winding and a load tap changer (LTC) having a plurality of windings coupled to one of the primary and secondary windings of the power transformer in order to regulate the output voltage of the power transformer. The LTC includes a plurality of taps physically and electrically connected to the windings. Contact is made to selected ones of the taps to increase or decrease the output voltage by moving a contacting element along the taps whose movement is controlled by a rotating shaft driven by a motor. A problem exists in ascertaining which tap is being contacted because the number of shaft rotations needed to go from a first tap to a second tap may be different than those needed to go form the second tap to a third tap, and so on. In accordance with the invention, the tap being contacted is determined by sensing and counting the number of shaft rotations causing the contacting element to move from a tap to a next tap and processing the information pertaining to the counted shaft rotations versus pre-stored information pertaining to the number of shaft rotations needed to go from any tap to any other tap. The information so processed enables determining that the contacting element has been moved from a tap to the next tap.

Means are also provided to sense the time it takes for a full shaft rotation and/or for a tap contact to move from one tap to the next tap. If the time exceeds a preset amount, a potential fault indication is generated. In addition there is also a need to track the various tap positions and the temperature of the LTC tank corresponding to each tap to aid in the detection of potential problems and "bad" taps and in the maintenance of the system. Still further, the system includes means for determining if the rate of tap change commands exceeds a predetermined number which would indicate a system instability.

The invention also includes a method to determine load tap change positions by examining several available electrical signals from a tap change mechanism and tracking the position of the taps being contacted. The invention also includes a method of recording the tap positions and the temperature of the LTC for selected tap positions and generating an alarm when certain predefined conditions, indicative of a problem, are exceeded. For example, if the temperature of the LTC tank for a given tap position exceeds a specified level, the contacting element may be moved from the given tap to another tap and the given tap may be bypassed in the future.

BRIEF DESCRIPTION OF THE DRAWINGS

In the accompanying drawing like reference characters denote like components.

DETAILED DESCRIPTION OF THE INVENTION

Note that certain aspects of this invention are also described in co-pending application titled SENSING LOAD TAP CHANGER (LTC) CONDITIONS bearing Ser. No. 11/520,542 and filed on the same day as this application and the teachings of which are incorporated herein by reference.

The invention will now be described with reference to FIGS. 3 through 8.

Figure 3:
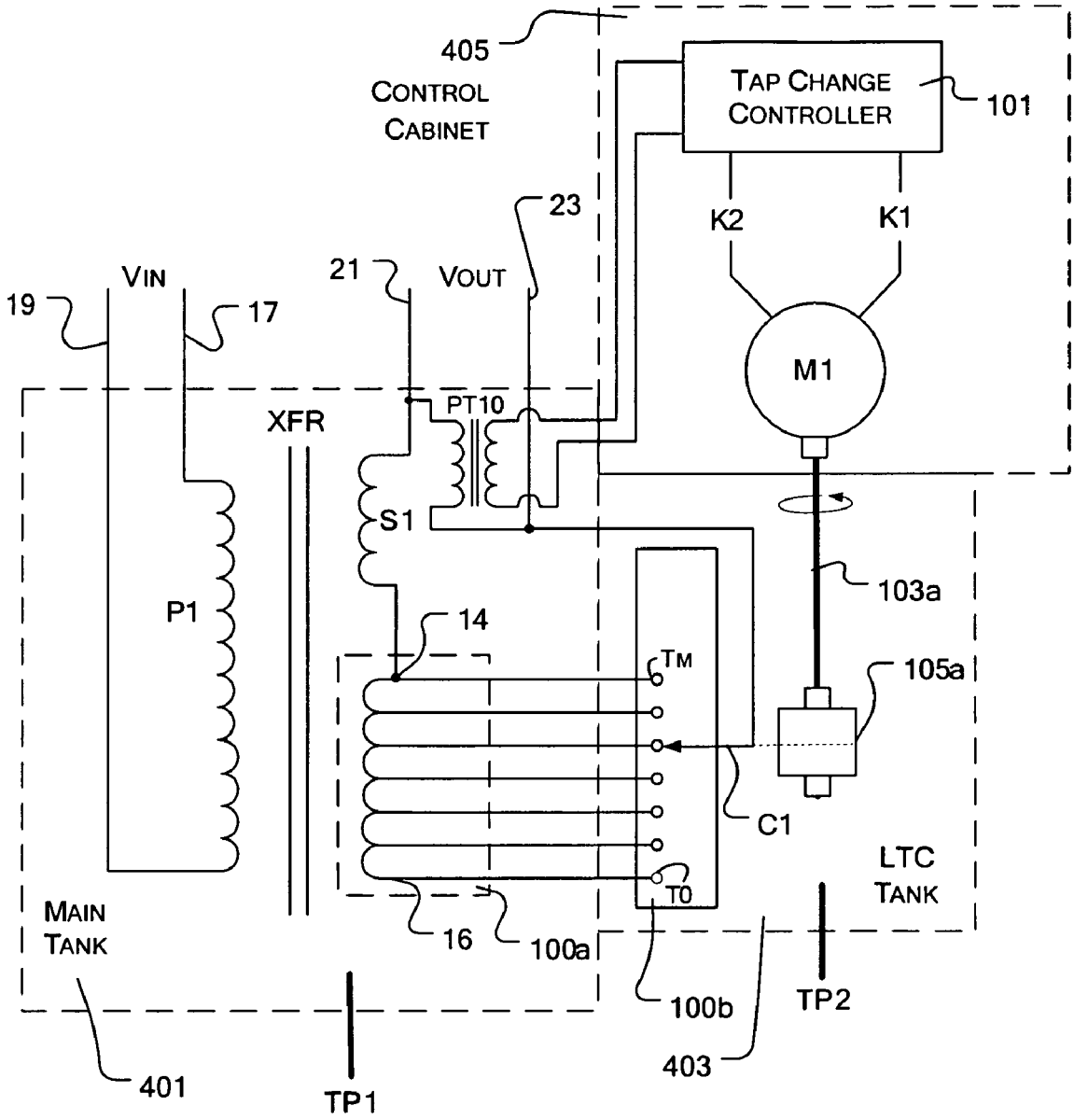
FIG. 3 is a simplified block diagram of a main tank for housing a power transformer side by side with an LTC tank housing the LTC taps and a control cabinet for housing LTC tap control circuitry and associated mechanism.

As shown in FIG. 3, the main power transformer, XFR, the LTC windings 100*a* and the potential sensing transformer PT10 may be located in a main tank 401. The LTC taps 100*b* (taps $T_0$-$T_M$ connected to windings 100*a*) may be located in a different, adjacent, LTC tank 403. The tap change controller and the motor M1, as well as some of the system electronics, may be located in an adjacent control cabinet 405. The tanks 401 and 403 may be filled with a liquid (e.g., oil) for distributing the heat generated by their respective components. A main tank temperature probe, TP1, (also called the top oil temperature probe) may be used to measure the temperature of the main tank 401. The LTC temperature probe, TP2, may be used to measure the temperature of the LTC tank. In general, the main transformer tank 401 and the LTC tank 403 are separate tanks and do not share the same fluid. However they are thermally connected. The volume of oil in the main tank is generally much greater than that in the LTC tank.

The main tank 401 contains the transformer primary and secondary windings and the LTC windings 100*a*. With loading, these windings generate heat due to $I^2R$ losses in the windings and eddy currents in the steel core. The heating in the main tank influences the temperature in the LTC tank. But, the temperature of the main tank should generally be higher than the temperature of the LTC tank since there is no significant source of heat in the LTC tank, when the LTC is operating correctly. However, heating in the LTC tank may occur, for example, when oil in the LTC tank 403, which is present between a contact C1 and a tap position, begins to polymerize. As this polymerization takes place the resistance of the contacts (between the contact C1 and the tap) increases. At first it may be virtually undetectable. However, the polymer film may begin to burn and it carbonizes further increasing the contact resistance. This gives rise to a vicious cycle that eventually causes the contacts to get so hot that the oil in the LTC tank may become hotter than that of the main tank.

The temperature difference between the main tank and the LTC tank is calculated to determine whether the temperature in the LTC tank 403 is more, or less, than the temperature in the main tank 401. This is monitored to determine if, and when, the temperature of the LTC tank exceeds the temperature in the main tank. If the LTC tank temperature exceeds the main tank temperature for longer than a preset period of time a problem may be present and an alarm is produced. By monitoring heat conditions, for each tap position, problems associated with excessive heat at some of the tap positions may be identified. This information is important to determine which tap position is defective when the LTC tank temperature for a particular tap position is continuously greater than main tank temperature for an extended period of time (e.g., a period of several hours). Each defective or "bad" tap position is identified and recorded arid a microcontroller (e.g., 150 in FIG. 5) may be programmed to cause the contacting element to by-pass the "bad" taps while ensuring that the output voltage (Vout) requirements controlled by the feedback loop which ordered that there be a tap change are satisfied.

Figure 1:
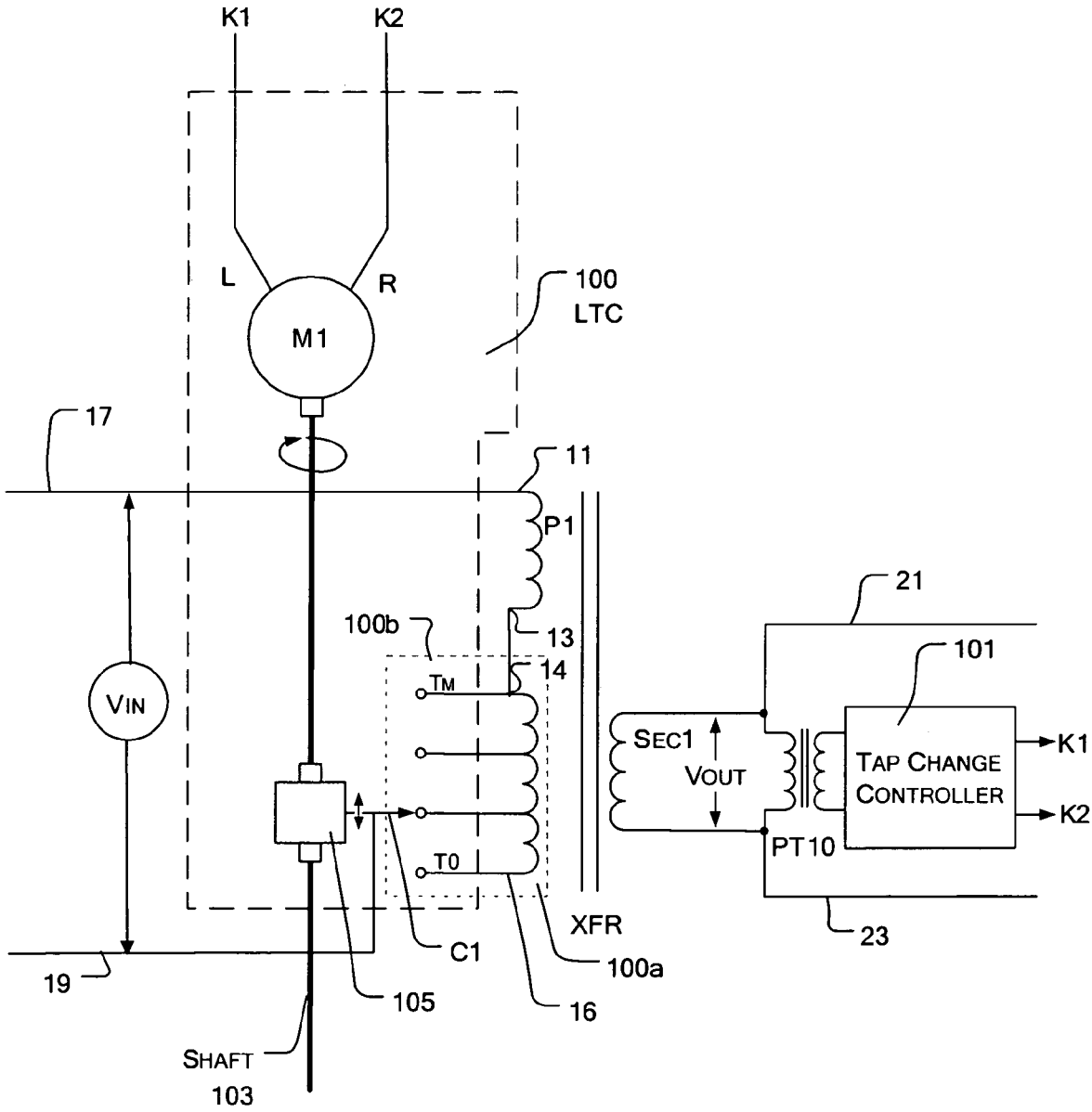
FIG 1 PRIOR ART
FIGS. 1 and 2 are highly simplified semi block, semi schematic, diagrams of prior art circuits including a power transformer and a load tap changer (LTC)
Figure 2:
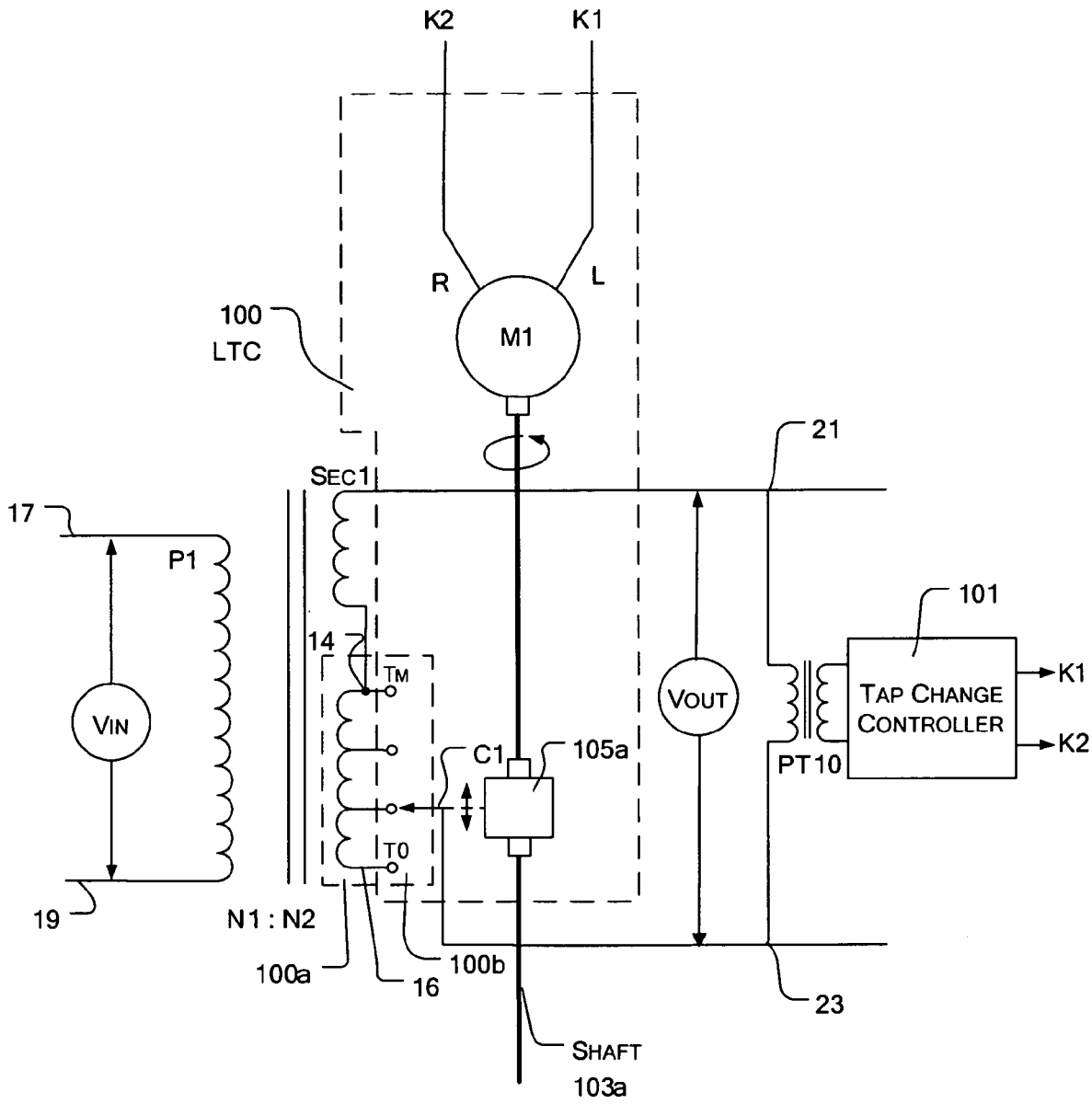
FIG 2 PRIOR ART

In accordance with the invention, the power transformer and LTC configuration of FIG. 1 is modified as shown in FIGS. 4 -7 to include: (a) circuitry (including circuits 135, 137 and circuit 301) for sensing signals (e.g., K1, K2) indicating the direction in which the shaft needs to rotate (i.e., producing signals indicative of the direction of movement) and that a tap change command signal has been generated directing or commanding that contact C1 must move from a tap to another tap (up or down); (b) circuitry (including a shaft rotation sensor 138 and counter 302) for sensing the shaft rotations and counting them; and (c) circuitry (including a sensor 139 and timer circuit 303) coupled to the tap changer mechanism 105 indicative of shaft rotations and movement of the contacting element for, among others, sensing the time it takes for the shaft to make one full shaft rotation and/or the time it takes for a contacting element to move form one tap to the next tap. The circuitry may include a microcontroller (e.g., 150) programmed to process and store selected information produced by these circuits.

The circuits of the invention enable tap changer positions (i.e., the taps) being contacted to be monitored and determined and to also be identified and displayed by sensing the direction and number of shaft rotations (or an equivalent) and using information specified by the manufacturer of the LTC; including information regarding the number of shaft rotations needed to go from a tap to the next tap and/or information observed and/or otherwise obtained about the rotation per tap of the LTC. Thus, following a command to change a tap, the number of rotations of shaft 103 are sensed (directly or indirectly) and recorded. Counting the number and direction of the shaft rotations and comparing the count to the pre-stored information pertaining to the number of rotations needed to go between valid taps, the tap being contacted can be determined (identified) and displayed.

Figure 8:
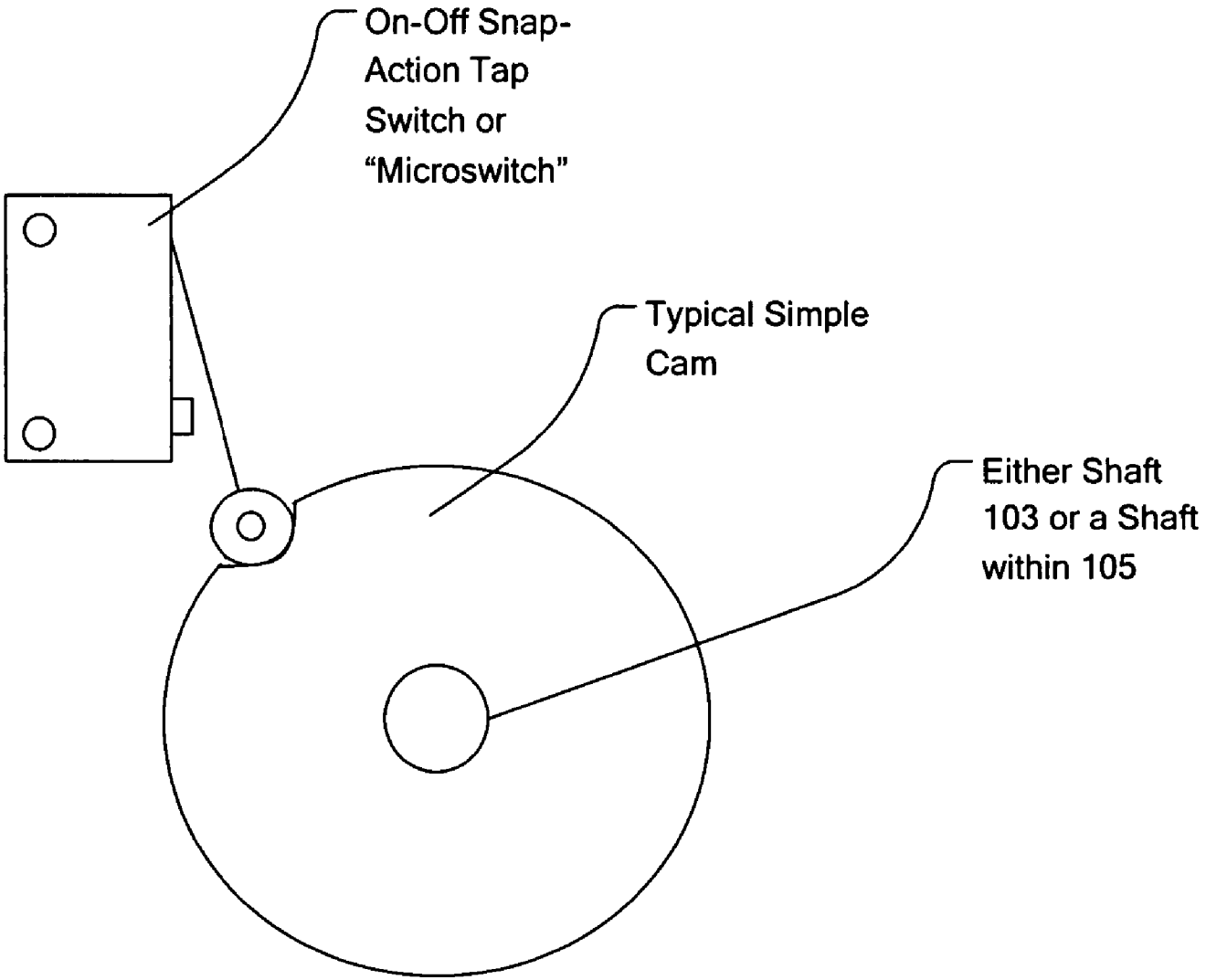
FIG. 8 is a drawing of a switch mounted to sense shaft rotations.

For purpose of illustration and ease of explanation, shaft rotation sensor 138 is shown coupled at its input to shaft 103 and at its output to counter 302 to count the number of shaft rotations. Sensor 139, also referred to as an on-off tap switch, is shown coupled at its input to tap changer mechanism 105 and at its output to timer 303. Sensors 138 and 139 may be (but need not be) the same device. Sensors 138 and 139 may be a microswitch, as shown in FIG. 8, or any other appropriate transducer appropriately mounted and capable of sensing shaft rotations (either directly or indirectly). Sensor 139 and timer 303 may be arranged to measure the elapsed time between shaft rotations. Alternatively, timer 303 may be used to measure the time it takes from the generation of a command to change a tap (in response to a K1 or K2 signal) until a full rotation of the shaft has occurred. That is, the elapsed time counted by timer 303 may begin whenever a signal (e.g., K1 or K2) is produced indicating the contacting element (e.g., C1) has to move up or down (in response to a K1 or K2 signal or a signal derived from them) and continues to count until shaft 103 has undergone a full rotation. Alternatively, signals K1 and K2 may function to enable a timer which would just count the elapsed time between shaft rotation signals.

As noted above, tap change controller 101 is programmed to sense whether the output voltage is below or above a desired condition. If it is above, controller 101 generates a signal (shown as K1) to lower the output voltage. If it is below, controller 101 generates a signal (shown as K2) to raise the output voltage. The lower and raise signals K1 and K2 (directly or indirectly) control the direction of rotation of motor MI which controls the direction of rotation of shaft 103 and also function to supply signals to circuit 301 to generate various tap change commands. Sensors 135,137 and circuit 301 may also include any device (optical, mechanical or electrical) which is responsive to tap change commands and can sense and provide signals pertaining to the rotation of the shaft 103. In response to signals K1 and K2, when shaft 103 is made to rotate in one direction (e.g., clockwise) it causes the contact (C1) to go up (rise) along the taps and when the shaft rotates in the other direction (e.g., counterclockwise) it causes the contact to go down (lower) along the taps. Thus, signals K1 and K2 function, via circuits 135,137 and 301 and programmed instructions in microcontroller 150 to: (a) provide information regarding the direction of movement of the contact C1; and (b) provide tap change commands (i.e., signals directing the contacting element C1 to move up or down).

Applicants recognized that the shaft 103 may have to undergo a number of rotations to raise or lower a contact (e.g., C1) from one tap position to the next tap position. The number of rotations, N, for a particular type of LTC, made by a particular manufacturer, may be different than the number of rotations specified for a different type of LTC made by the same, or another, manufacturer. In addition, there are instances when "N1" rotations are needed to go from a tap Ti to another tap T(i+1) and "N2" rotations are needed to go from a tap T(i+1) to a tap T(i+2); where N1 and N2 are different numbers. Thus, the number of rotations to go between different taps may differ. However, the number of rotations to go from any tap to another tap, for any particular piece of equipment, is generally specified by the manufacturer or can be determined by testing and/or examination. In accordance with the invention, this information is-stored and programmed into the system (e.g., stored in the memory 157 or in look up tables associated with microcontroller 150 shown in FIG. 5) and is used to identify and display the tap positions being contacted by contacting element C1.

Figure 4:
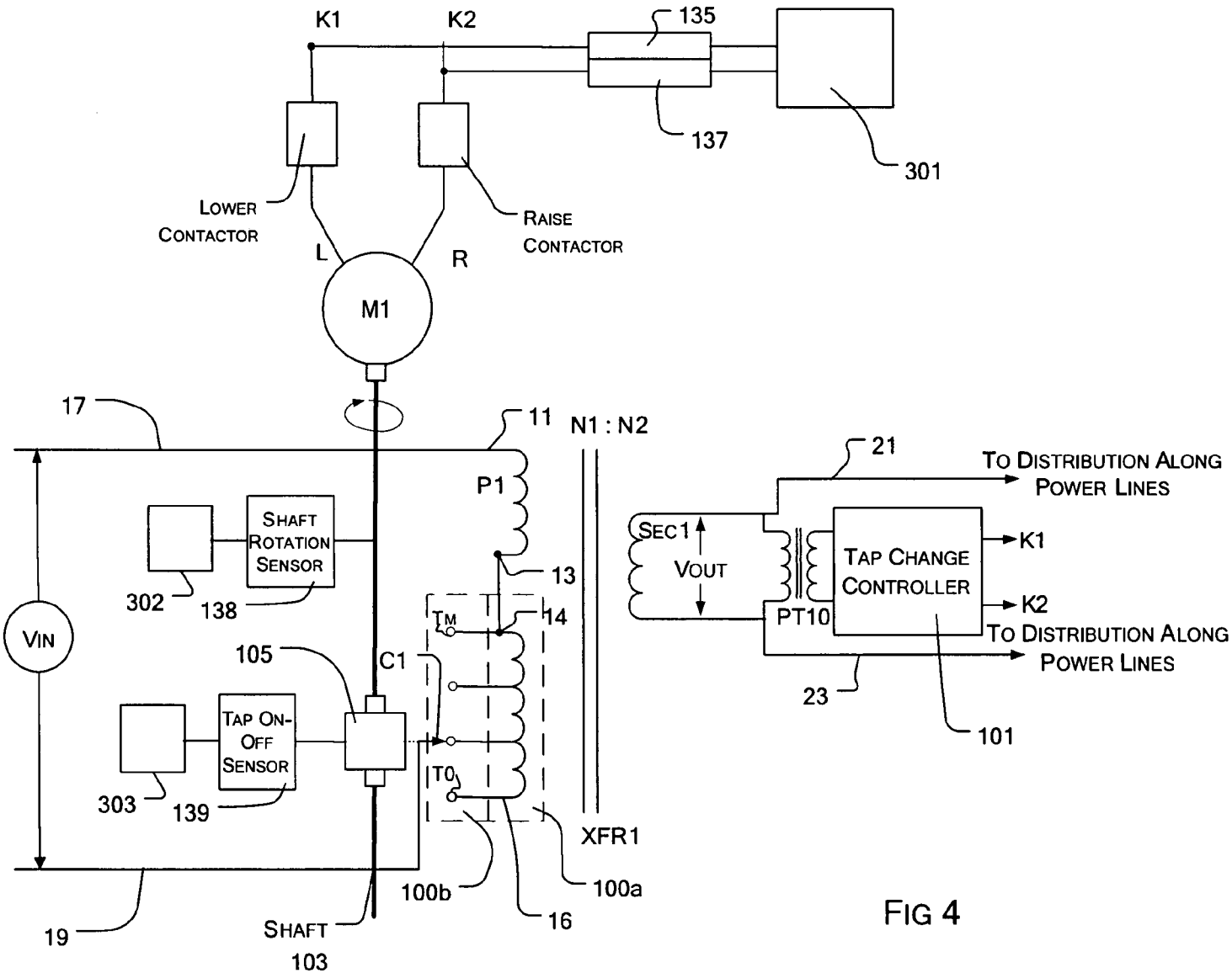
FIG. 4 is a simplified semi block, semi schematic, diagram detailing some of the circuitry used to practice the invention.

Referring to FIG. 4, assume, for example, that contact C1 is at tap $T_0$ and that a "raise" signal is produced by controller 101 to cause contact C1 to go to a higher tap. Assume also that it is known that to go from tap $T_0$ to tap TI requires two rotations of shaft 103. In response to a raise (K2) signal, the motor M1 causes shaft 103 to rotate in a direction which causes the mechanism 105 to move and advance contact C1 from tap $T_0$ to tap T1. As the shaft 103 rotates and the mechanism 105 moves, the movement of the shaft, and/or that of mechanism 105, is sensed (via sensor 138 or sensor 139) and signals indicative of the shaft rotation are supplied to a counter register (see FIG. 5A). Assume also, for purpose of illustration, that one pulse per shaft rotation is generated and fed to a counter (e.g., 302). Upon counting two pulses in the raise direction, the system recognizes that the contact C1 has advanced form tap $T_0$ to tap T1. This information can then be used to increment the registers and the fact that the contact is now at tap T1 is displayed and stored in a register. If, and when, the contacting element is then directed to go from tap T1 to tap T2, the described process is repeated. That is, the number of shaft rotations are counted and compared to the stored number of rotations needed to go from tap T1 to Tap T2. Assume the number to be 3. When 3 shaft rotations have been counted, the system recognizes that the contacting element is at tap T2 and the appropriate register is updated to indicate that tap T2 is being contacted.

Figure 5:
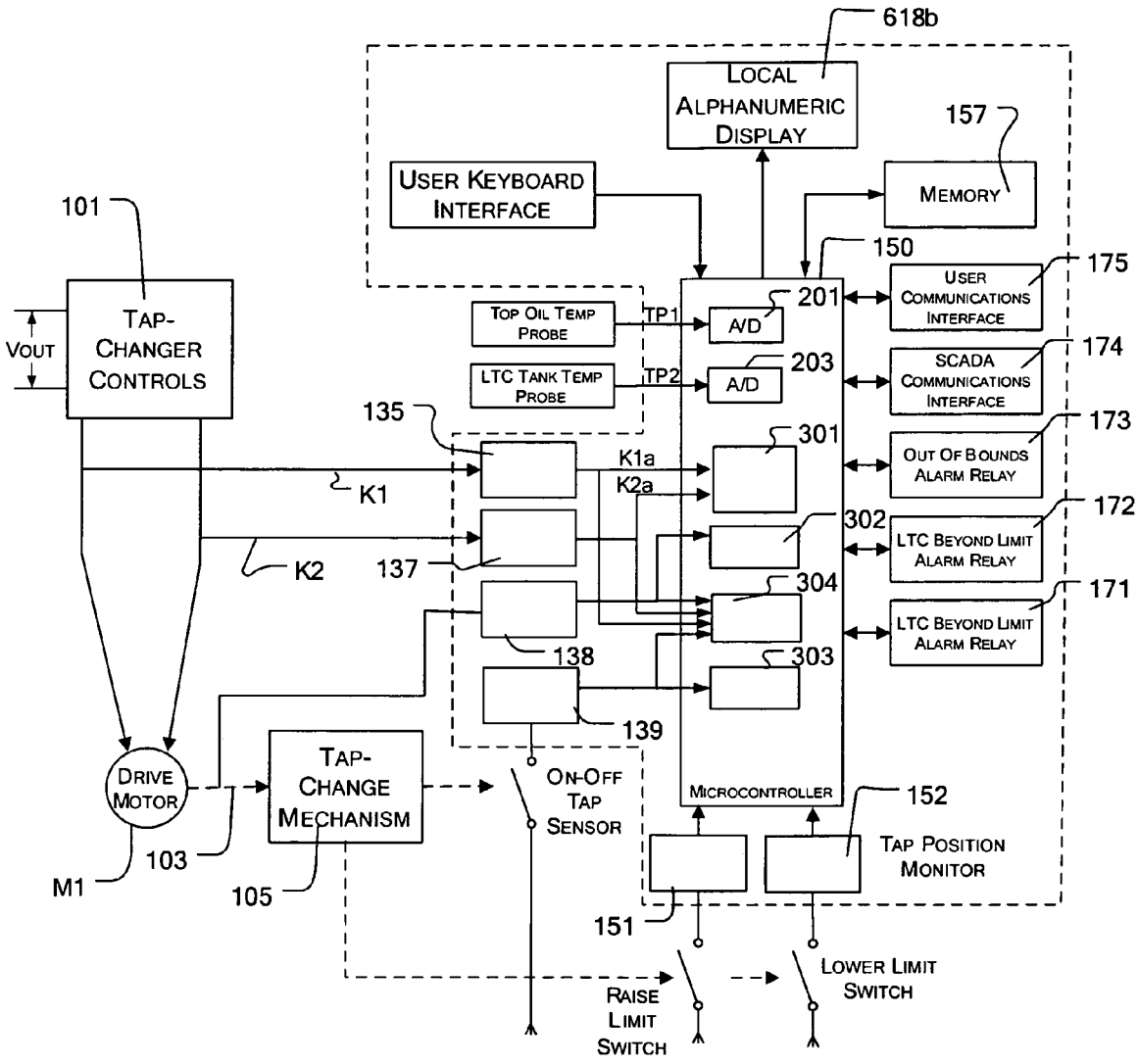
FIG. 5 is a block diagram of signal processing circuitry in accordance with the invention.

FIG. 5 is a block diagram illustrating system components which may be used to practice the invention. The system includes a microcontroller 150 which is designed and programmed to receive and process various signals including temperature information and to also store and process information pertaining to tap positions. Microcontroller 150 is shown to include a circuit 301 to process the K1 (and K1*a*) and K2 (and K2*a*) signals generated by tap change controller 101. Signals K1 and K2 are applied via amplifiers/buffers 135,137 to circuit 301 which is designed to respond to these signals and produce information regarding: (a) the direction of motion resulting form K1 and K2; and (b) the occurrence of a tap change command (up or down).

In FIG. 5, microcontroller 150 is also shown to include counter circuit 302 which is designed to respond to the output of rotation sensor 138 in order to count and process the number of shaft rotations to enable the calculation of the advancement (incrementing) or lowering (decrementing) of the taps. Microcontroller 150 is also shown to include timer circuit 303 which is designed to respond to the output of sensor 139 to determine the time it takes for a full rotation of the shaft 103, or the time it takes for the contacting element to advance from one tap to the next. Microcontroller 150 also includes a circuit 304 responsive to tap change commands or to shaft rotation signals to calculate the number of change tap commands occurring within preset times. Controller 150 also includes circuitry responsive to sensors 151 and 152 which function to couple signals to controller 150 indicating that the highest tap (raise limit) or the lowest tap (lower limit) position has been reached. Controller 150 also includes analog to digital (A/D) converters (201, 203) coupled to the outputs of temperature probes TP1, TP2, in order to sense and process the temperature of the main tank 401 and of the LTC tank 403. These measurements may be used to determine whether there are any "bad" taps and to program the system to bypass them. In addition, there is associated with the controller a memory bank 157 which may include one, or more, look up tables and/or other data bank in which information pertaining to the different shaft rotations per tap and other system characteristics may be pre loaded. As already discussed, the controller 150 is programmed to process the information from the various sensors and memory banks and provide controls to sound various alarms, indicators and displays of the desired information. Circuits 301, 302, 303 and 304, as well as the other registers and processing circuits are shown to be part of controller 150. However, they may also be part of an external computer system.

Figure 5A:
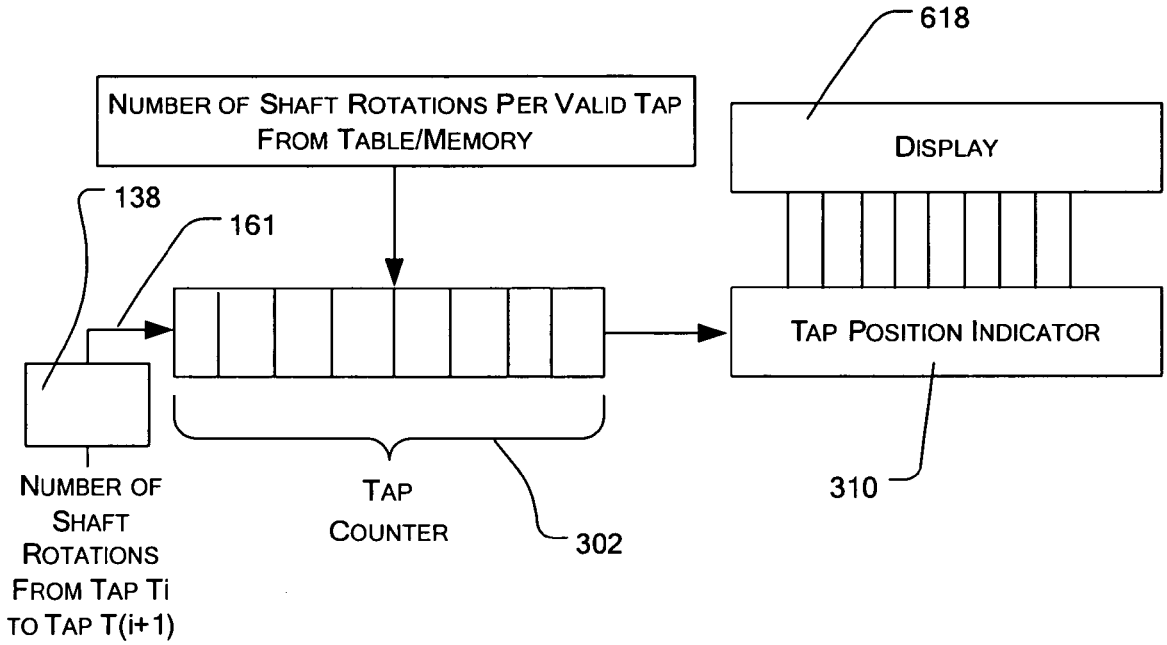
FIG. 5A is a block diagram of registers and counters for determining tap positions.

FIG. 5A shows that shaft rotation sensor 138 produces signals 161 corresponding to the number of rotation(s) of shaft 103. The signals 161 are applied to counter/register 302 which is preset or preprogrammed with information stored in memory regarding the number of rotations needed to go from any tap T(i) to the next tap (up or down). Thus, by keeping track of the taps and knowing which tap is presently being contacted and counting the number of shaft rotations (up or down) and knowing the number of shaft rotations needed to go form one tap to the next, the tap positions of the LTC can be determined and identified and counter 302 then functions as a tap counter. The output of counter 302 may be supplied to a tap position indicator 310 which registers and stores the tap being contacted and this information is also supplied and displayed by a display 618.

Thus, as shown in FIGS. 4, 5 and 5A, the number of shaft rotations of shaft 103 may be sensed via a shaft rotation sensor 138 (or sensor 139) and signals 161 corresponding to the number of rotations are fed to a microcontroller 150 which includes registers/counters to track the travel of the contact C1 from tap to tap, as further discussed below. Given the direction of rotation/travel of the shaft 103 (from sensor 301) and given the number of rotations which shaft 103 undergoes (from counter 302) and taking into account the known number of rotations needed to go from a present tap to a next tap, it is possible to continuously determine and/or track and/or display the tap position being contacted (i.e., which tap is being contacted).

As already discussed a sensor 139 (or 138) is coupled at its input to tap changer mechanism 105 (or shaft 103) and at its output to timer 303 which may be programmed to measure either the time it takes for one full rotation of shaft 103 or the time it takes the contacting element to move from one tap to a next tap (up or down). Alternatively, a pre-set time delay may be loaded into interval timer 303 contemporaneously with a tap change command. The timer 303 can then be used to sense if, and when, the time delay is exceeded, The significance of measuring the time it takes to make a full shaft rotation or, alternatively, the time it takes to go from one tap to the next (up or down) is that the travel time per shaft rotation, or between taps, should occur within a specified time range. If the time is exceeded, there may be a problem such as a loose linkage; binding or seizing of the mechanism. In accordance with the invention, the time per shaft rotation and/or to move between taps is monitored and if the time exceeds a preset amount, the user/operator is alerted (audibly and/or visually) to the possibility of a problem. In accordance with the invention, an alarm may be generated when the time for a shaft rotation exceeds a given time or the tap changer mechanism remains off tap for longer that a preset time delay. This alarm, once it occurs, may be sealed in and can only be reset through operator intervention. So, whether the LTC changer mechanism 105 (which includes the shaft rotation mechanism and control) is operating correctly can be determined by monitoring the time it takes for the shaft to make a full rotation and/or, alternatively, the time it takes for the contact C1 to move from one tap position to another tap position As noted above, when a command to change a tap change is generated, a timer 303 starts counting the time it takes for a full shaft rotation. Alternatively, it measures the time for completing a tap change [i.e., the time it takes for contact C1 to move form tap T1 to a tap T(i+1) or a tap T(i−1)]. Signals derived from sensor 138 or sensor 139 and their associated circuitry can generate signals to stop the timer 303. If the timer is not stopped before a preset time, an alarm signal is generated.

As already discussed, an additional feature of the invention relates to ascertaining the operability and functionality of the taps. To determine whether any tap position is inoperative or malfunctioning, systems embodying the invention include means for determining tap positions and the temperature in main tank 401 and LTC tank 403. Evaluating the temperature gradient between tank 401 and the LTC tank enables the operation of the LTC 100 to be restricted to known good taps and assists in diagnosing which contact/tap position is defective before performing maintenance.

Figure 6:
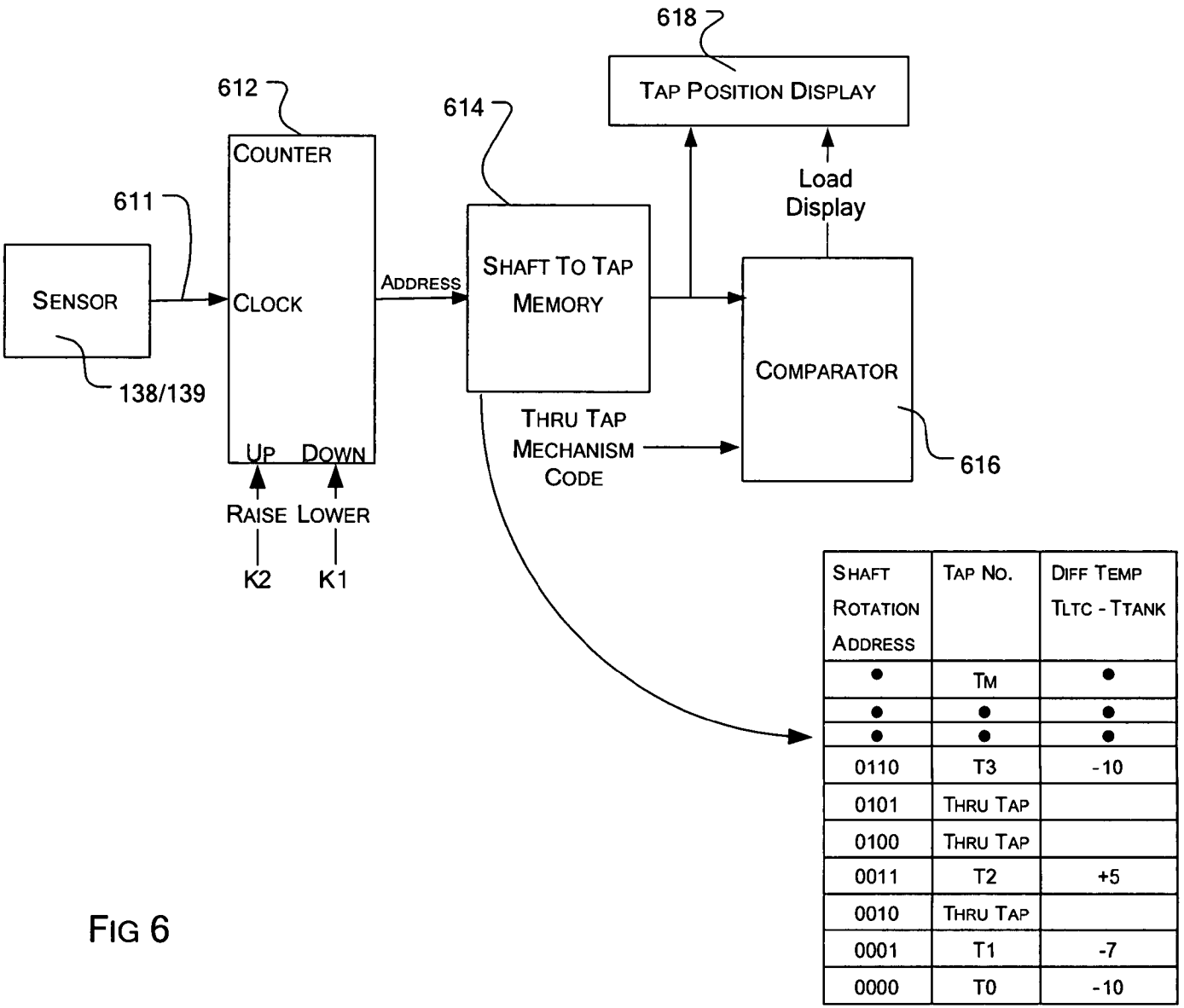
FIGS. 6 and 6A are block diagrams of different embodiments of circuitry for tracking the taps being contacted in accordance with the invention.

FIG. 6 illustrates a circuit implementation of sensor 138 or 139 connected to counter 302 and controller 150. Shaft rotation signals, derived from the output of sensor 138 or sensor 139, are applied via a line 611 to the clock input of a counter 612 which counts up or down depending on the state of the signals K1 or K2 from tap change controller 101. In response to a shaft rotation signal on line 611, the counter 612 increments or decrements an address signal applied to a shaft-to-tap memory circuit 614 which functions as a look-up table containing an entry for every possible shaft rotation. As shown in the table accompanying the FIG. 6 drawing, the memory 614 is programmed such that a shaft rotation address either corresponds to a tap, as indicated, or to a through-tap. For example, address 0000 corresponds to tap $T_0$ and one shaft rotation (up) raises the count to 0001 and corresponds to tap T1. The next shaft rotation (up) raises the count to 0010. But, there is no tap corresponding to this shaft position and address. On the next shaft rotation (up) the address is incremented to 0011 corresponding to which there is a tap T2. Thus to go from tap T1 to tap T2 requires two (2) shaft rotations. By way of example, the table also shows that to go from tap T2 to tap T3 requires 3 shaft rotations. That is, the number of rotations between taps can vary. In FIG. 6 the data output of memory 614 is fed into a comparator 616 which compares the information from memory 614 with a unique code representing a thru tap mechanism operation. If the comparator 616 senses an appropriate match at its inputs it provides an enabling load display signal to tap position display 618, which then will display the tap position being contacted as determined by the shaft rotation address.

The table of FIG. 6 also includes a column titled "DIFF TEMP" which illustrates the reporting of the temperature differential ($T_{DIFF}$) between the LTC tank temperature ($T_{LTC}$) and the main tank temperature ($T_K$) for the various tap positions. A negative number indicates that $T_K$ is greater than $T_{LTC}$. A positive number indicates that $T_{LTC}$ is greater than (exceeds) $T_K$. As discussed above if the excess is more than a specified value, the contacting element is moved to another tap and/or the identified tap (e.g., T2) is denoted as a bad tap and its future use is prevented.

Figure 6A:
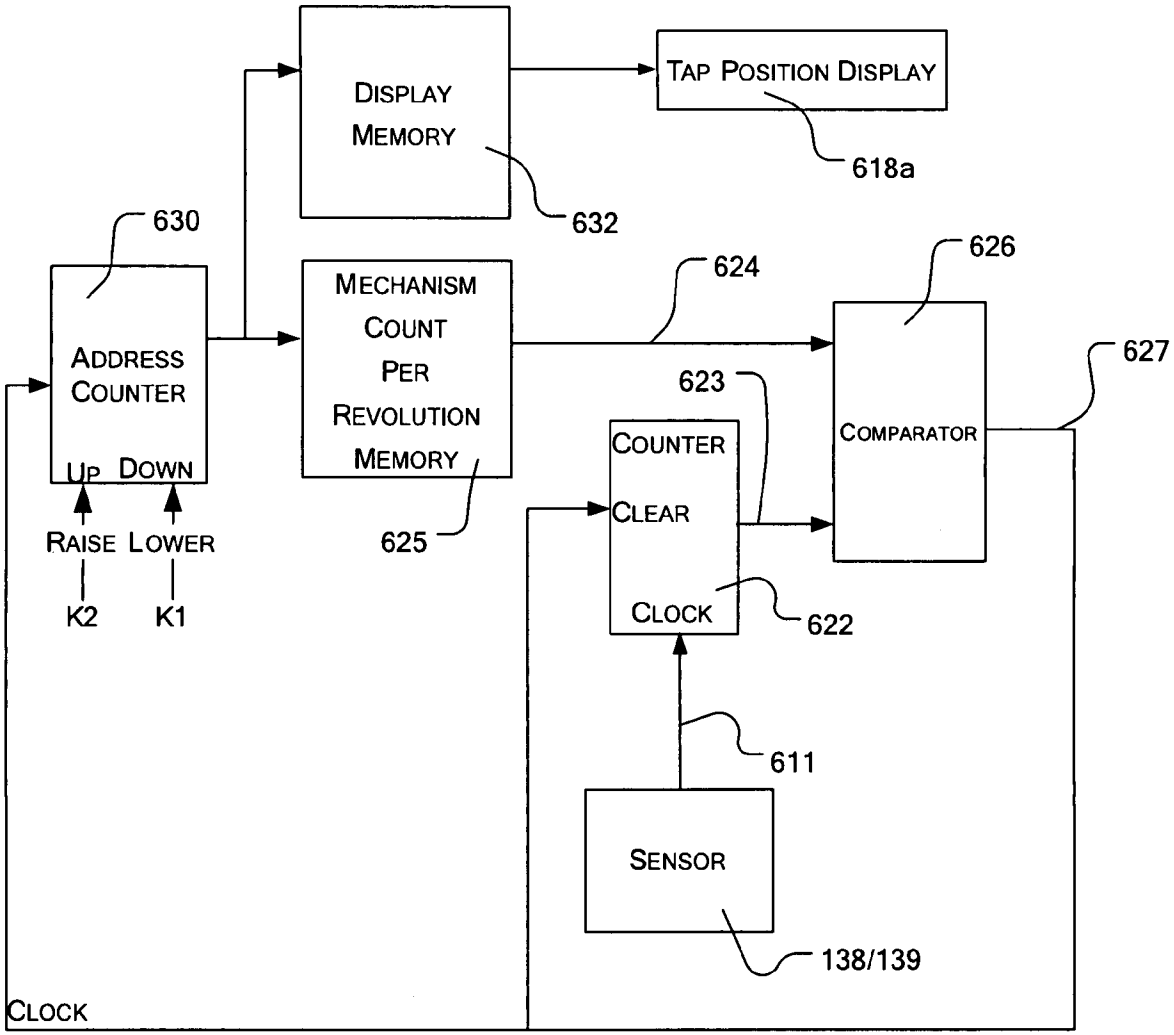

FIG. 6A illustrates another circuit for counting shaft rotations. Shaft rotation signals derived from the output of sensor 138, or sensor 139, are applied via a line 611 to the clock input of a counter 622. The output 623 of counter 622 and an output 624 of memory 625 are compared in a comparator 626. Note that memory 625 is designed to provide signals regarding shaft rotations or revolutions derived from the mechanism 105 mounted on, and driven by, the shaft. When the output of the counter 622 matches the value outputted from memory 625, the comparator 626 produces an output (denoted as a CLOCK signal) on line 627 applied to the clock input of an address counter 630 which functions to increment or decrement the address counter 630, depending on the state of K1 or K2 from controller 101. The CLOCK signal also clears counter 622 to start counting when sensor 139 (or 138) provides a signal to do so. The output of the address counter 630 provides a new address to the memory 625 and to a display memory 632. An output from the display memory is loaded into a tap position display 618*a*, which is designed to display the tap being contacted by the contacting element.

Another aspect of the invention relates to sensing if tap positions are changing, or made to change, too frequently in a given period of time. This is generally indicative that the system is unstable and/or is oscillating. The number of tap changes within any set time interval may be monitored and, if there are more than a certain pre-determined number of tap changes within the set time interval, an alarm signal indicating a potential problem is produced.

Figure 7:
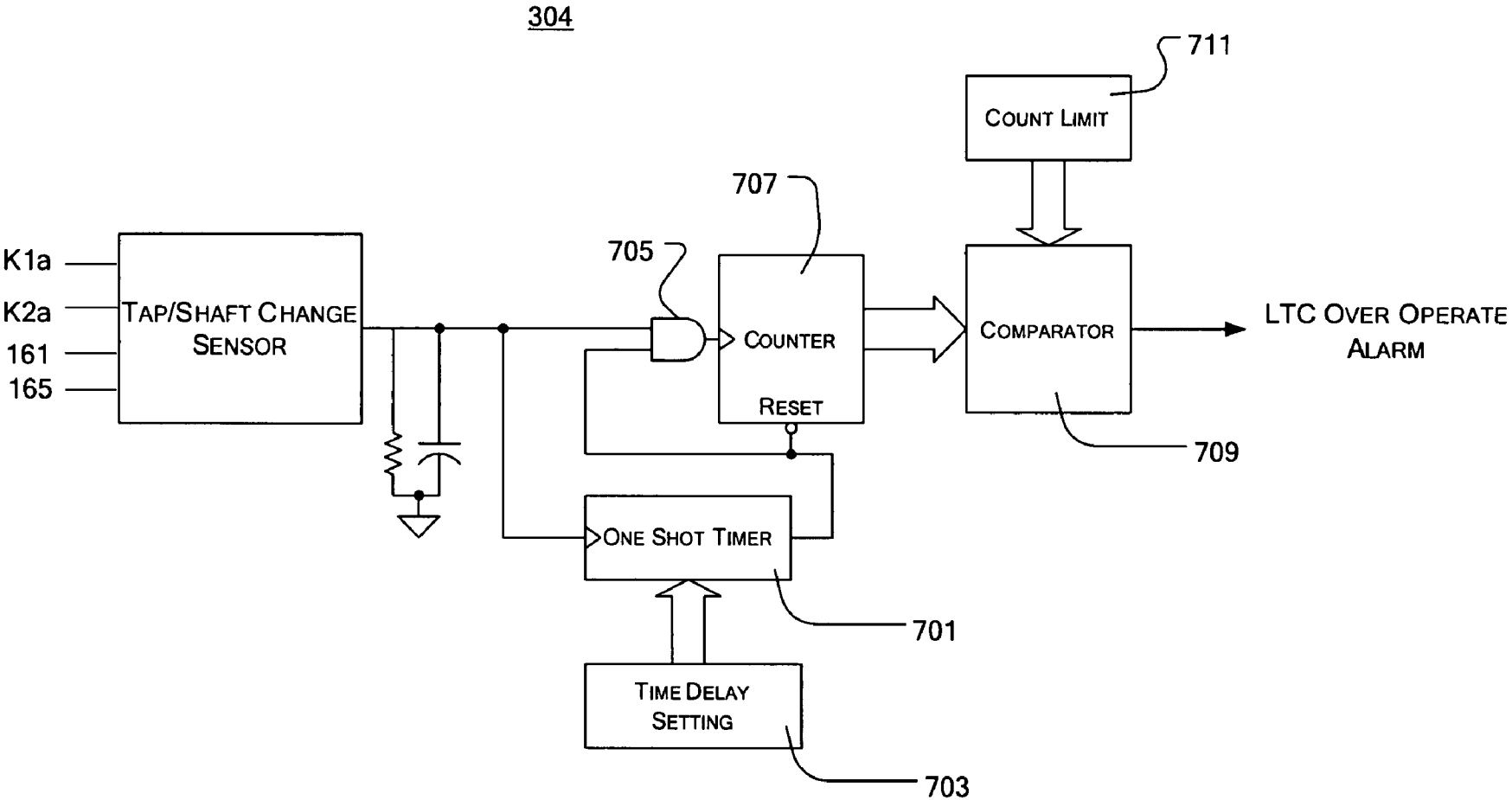
FIG. 7 is a block diagram of a circuit for ascertaining the rate of tap change commands in accordance with one aspect of the invention.

FIG. 7 is a semi-block semi-schematic diagram illustrating an implementation of circuit 304 with microcontroller 150 for sensing whether the number of shaft rotations and/or tap change commands produced within a given time period exceeds a desired limit. In response to a signal or signals (derived from K1 and/or K2 produced by controller 101 or line 161 from shaft rotation sensor 138 or line 165 from mechanism 105 produced by sensor 139) indicative of a demand for a tap change (up or down) a non retrigger-able monostable multivibrator 701 is triggered and produces an enabling output applied to an AND gate 705. The enabling output of the one-shot 701 is designed to last for a time Tx which is controlled by time delay setting control 703. During the time Tx, signals from K1 and/or K2 and/or from sensor(s) 138 or 139 are supplied to a counter 707 whose output is compared in comparator 709 against a preset value derived from count limit 711. If the count from counter 707 exceeds the desired count limit an alarm signal is generated indicating an excessive number of tap change commands or shaft rotations within a set period (e.g., Tx). Thus, circuit 304 may be programmed to sense tap change related signals generated by the system (e.g., K1 and/or K2, and/or the outputs of sensors 138 or 139) and totaling the signals on a predetermined time base (e.g., per minute, hour or day). if, and when, the number of signals exceeds a predetermined acceptable limit an alarm signal is generated. The circuit can then sense how often there is a demand or command for a tap change and whether the demands or commands for a tap change within a given time period exceed a preset amount. The circuit can also be used to total the number of tap changes which have occurred to determine when servicing of the equipment should take place.

It has been shown that automatic tap change operation occurs using a tap changer controller (e.g., 101) for monitoring the output voltage and generating signals to raise or lower voltage. Manual adjustment may be accomplished through a manual crank (not shown) and remote operation may be accomplished from the control center (user keyboard interface in FIG. 5) to override the automatic control.

Typically, once a tap change operation is set in motion, certain on-off tap (cam) switches close to force the operation to continue until a new tap position is reached. One of two relays will be energized, a raise relay (R) or a lower relay (L). During the tap change operation a cam switch connected mechanically to the mechanism will change state to signal that a tap change operation has taken place. This switch is commonly used to operate a counter to total the operations such that maintenance can be scheduled.

In accordance with the invention, the monitoring and sensing of the taps being contacted is achieved by sensing the number of rotations of the shaft 103 (or a corresponding part such as the tap change mechanism) and noting the direction of rotation. The shaft rotations may be sensed mechanically or electro mechanically or optically or electro-magnetically. In one embodiment, a sensing switch travels on a cam mounted on the main shaft driving a big rotary switch. The shaft, when set in motion generally rotates a full 360 degrees. If a "raise" relay is energized, it is a raise operation and the specified number of rotations to go from one tap to the next higher tap is loaded (or pre-loaded or programmed) into tap counter 302. If a "lower" relay is energized, it is a decrementing (lower) operation and the number of rotations to go from the tap to the next lower tap is loaded into the tap counter 302. The number of rotations per tap need not be constant, so long as the manufacturer specifies the different numbers of rotations for different taps. It can all be programmed into the controller. For a "lowering" operation, once the contacting element makes contact with the next lower tap, the tap counter 302 is decremented by one.

To ascertain the actual tap positions being contacted the following settings are made specific to the manufacturer's model LTC: a—The names and number of the tap positions for the particular LTC; and b—The number of revolutions or rotations of the shaft which are required to go from one tap position to another in the "raise" direction and in the "lower" direction.

In addition, the desired or specified time interval to go from one tap to another tap may be specified and stored in memory or programmed in the system for subsequent use.

The invention has been illustrated with a motor and rotating shaft for moving the contacting element. It should be appreciated that other mechanisms may be sued to move the contacting element in response to a tap change command and there are aspects of the invention compatible with these other means (i.e., they do not require a motor and rotating shaft).

What is claimed is:

1. In combination with a power transformer having a primary winding and a secondary winding, a load tap changer (LTC) having a plurality of windings coupled to one of the primary and secondary of the power transformer in order to regulate the output voltage of the power transformer, and wherein the LTC includes a plurality of taps physically and electrically connected to the LTC windings and wherein contact is selectively made to the LTC taps to increase or decrease the output voltage by moving a contacting element from a tap to another tap and the movement of the contacting element is controlled by a rotating shaft driven by a motor, and wherein the shaft may rotate a number of times in going from one tap to the next tap, means for tracking and ascertaining which tap the contacting element is contacting, comprising:

means for storing information pertaining to the taps and the number of shaft rotations needed to go from any tap to any other tap;

means for sensing and counting the number of shaft rotations causing the contacting element to move from a tap to a next tap; and means responsive to the number of shaft rotations counted and to the stored information pertaining to the number of shaft rotations needed to go from a tap to the next tap for determining that the contacting element has been moved from a tap to the next tap.

2. In the combination as claimed in claim 1, wherein said means for sensing and counting the number of shaft rotations also includes means for sensing the time taken for a full rotation of the shaft.

3. In the combination as claimed in claim 2, wherein said means for storing information pertaining to the taps includes storing a specified length of time which it should take for a full rotation of the shaft, and wherein this is compared to the actual sensed time taken for a full rotation of the shaft; and wherein if the sensed length of time exceeds the specified time it should have taken, an alarm signal is generated.

4. In the combination as claimed in claim 2, wherein said means for sensing and counting the number of shaft rotations also includes means responsive to the direction of rotation of the shaft for determining the direction of movement of the contacting element.

5. In the combination as claimed in claim 3, wherein the information pertaining to the number of taps and the number of shaft rotations per tap is supplied by the manufacturer and is permanently stored.

6. In the combination as claimed in claim 1, wherein the power transformer is located in a main tank and the taps of the LTC are located in an LTC tank, different than said main tank, and wherein the temperature of the two tanks is measured for each tap position being contacted with the contacting element.

7. In the combination as claimed in claim 6 wherein if, for a given tap position, the temperature of the LTC tank exceeds the temperature of the main tank for a specified time, the given tap position is deemed bad and the contacting element is moved to another tap position.

8. In the combination as claimed in claim 6 wherein if, for a given tap position, the temperature of the LTC tank exceeds the temperature of the main tank for a specified time, the given tap position is deemed bad and the information regarding the bad tap is stored to enable the system to bypass the bad tap position.

9. In the combination as claimed in claim 1, wherein a tap change command signal is produced contemporaneously with a signal directing the contacting element to move from one tap to a next tap; and wherein a counting means is provided for counting the number of tap change commands within a predetermined time interval.

10. In the combination as claimed in claim 1, further including display means for displaying the tap to which the tap contact is making contact.

11. In the combination as claimed in claim 1 wherein there is included means responsive to the output voltage of the power transformer for producing tap change command signals for causing the contacting element to move to a tap tending to cause the output voltage to equal a specified value, and wherein said means for sensing and counting shaft rotations is responsive to each tap change command.

12. In the combination as claimed in claim 11 including means for counting at least one of (a) the number of times tap change command signals are produced within a given time interval and (b) the number of shaft rotations within a given time interval, and means for producing an alarm signal if the number exceeds a specified amount.

13. In a system which includes a load tap changer (LTC) having a plurality of windings, selected ones of which are selectively coupled to one of the primary and secondary of a power transformer in order to regulate the output voltage of the transformer and wherein the LTC includes a plurality of taps physically and electrically connected to and along the windings and contact is selectively made to the taps to increase or decrease the output voltage by moving a contacting element from one tap to the next tap in response to a tap change command signal, the improvement comprising:

means for sensing and counting at least one of (a) the number of times tap change command signals are produced within a given time interval and (b) the number of shaft rotations within a given time interval, and means for producing an alarm signal if the number exceeds a specified amount.

14. In a system which includes a load tap changer (LTC) having a plurality of windings, selected ones of which are selectively coupled to one of the primary and secondary of a power transformer in order to regulate the output voltage of the power transformer and wherein the LTC includes a plurality of taps physically and electrically connected to, and along, the windings and a contacting element is selectively moved along the taps to increase or decrease the output voltage of the power transformer and wherein the power transformer and the LTC windings are placed in a main tank and the LTC taps are placed in an LTC tank, and wherein the temperature in the main tank and the temperature in the LTC tank are monitored by means of a first and second probe, the improvement comprising:

means for sensing the temperature differential between the main tank and the LTC tank and means for determining if the LTC tank temperature exceeds the main tank temperature for a period of time exceeding a specified time period; and means for sensing the temperature differential for each tap position and monitoring those taps for which the LTC tank temperature exceeds the main tank temperature.

15. In the system as claimed in claim 14, further including means for recording those taps for which the LTC tank temperature exceeds the main tank temperature and including means for bypassing those taps.

* * * * *